US009340397B1

(12) United States Patent
Hernandez

(10) Patent No.: US 9,340,397 B1
(45) Date of Patent: May 17, 2016

(54) ILLUMINATED VEHICLE LIFT ASSEMBLY

(71) Applicant: Islay Hernandez, Hialeah, FL (US)

(72) Inventor: Islay Hernandez, Hialeah, FL (US)

( * ) Notice: Subject to any disclaimer, the term of this patent is extended or adjusted under 35 U.S.C. 154(b) by 97 days.

(21) Appl. No.: 14/477,291

(22) Filed: Sep. 4, 2014

(51) Int. Cl.
*B66F 5/04* (2006.01)
*B66F 17/00* (2006.01)
*B66F 3/24* (2006.01)

(52) U.S. Cl.
CPC . *B66F 5/04* (2013.01); *B66F 3/247* (2013.01); *B66F 17/00* (2013.01); *B66F 2700/057* (2013.01)

(58) Field of Classification Search
CPC ..... B66F 2700/05; B66F 2700/055; B66F 2700/057; B66F 3/24; B66F 3/247; B66F 3/42; B66F 5/00; B66F 5/04
USPC ..... 439/119, 34, 374, 476.1, 484, 91; 254/89 H, 93 H, 93 R, DIG. 1, DIG. 3, 254/DIG. 4
See application file for complete search history.

(56) References Cited

U.S. PATENT DOCUMENTS 1,483,603 A * 2/1924 Bibb ..... B66F 1/06 254/108
1,514,120 A * 11/1924 Alters ..... B66F 3/16 254/103
3,595,525 A * 7/1971 Yaste ..... B66F 3/28 254/2 B
4,330,104 A * 5/1982 Klok ..... B66F 3/24 254/93 A
5,301,389 A * 4/1994 Engel ..... B66F 13/00 16/422
5,383,536 A * 1/1995 Butter ..... B60B 33/0078 188/1.11 R
5,651,532 A * 7/1997 Page ..... B66F 13/00 254/8 B
5,992,826 A * 11/1999 Simmonds ..... B66F 3/16 254/103
6,357,724 B1 * 3/2002 Hung ..... B66F 5/00 254/8 B
6,910,677 B1 * 6/2005 Miller ..... B66F 3/12 254/103
7,588,341 B2 * 9/2009 Lin ..... A47G 19/2227 254/45
8,500,095 B1 * 8/2013 Salcedo ..... B66F 5/025 254/101
2003/0043581 A1 * 3/2003 Finnigan ..... B66F 5/00 362/253
2004/0221439 A1 * 11/2004 Villarreal ..... B66F 3/247 29/407.08

FOREIGN PATENT DOCUMENTS

WO WO 0064323 A1 * 11/2000 ..... A47L 9/00

* cited by examiner

*Primary Examiner* — Joseph J Hail
*Assistant Examiner* — Tyrone V Hall, Jr.
(74) *Attorney, Agent, or Firm* — Albert Bordas, P.A.

(57) ABSTRACT

An illuminated vehicle lift assembly having a jack assembly with a top wall, a base wall, first and second lateral walls, a front wall, a rear wall, and wheels. The jack assembly further has power means and illumination means. The illuminated vehicle lift assembly further has a handle assembly and an electrical system. The handle assembly mounts onto the jack assembly, whereby an end is forced into a receiving slot until a first electrical connector couples with a second electrical connector, and retaining walls block, or otherwise restrict, locking protrusions. The illuminated vehicle lift assembly facilitates lifting of a vehicle for changing a vehicle wheel assembly.

15 Claims, 4 Drawing Sheets

ILLUMINATED VEHICLE LIFT ASSEMBLY

BACKGROUND OF THE INVENTION

1. Field of the Invention

The present invention relates to jack assemblies, and more particularly, to illuminated vehicle lift assemblies.

2. Description of the Related Art

Most people that routinely drive a vehicle, such as an automobile, have experienced a flat tire. For some, changing a flat tire is a simple task and does not require much thought or effort in normal conditions. For other people however, changing a flat tire is a very difficult task. Often the difficulty arises because the person simply does not have sufficient strength to manually operate a jack to lift the vehicle. One of the most difficult situations is when the flat tire takes place at night in an isolated area.

Many vehicle jacks have been developed in the past. However, patents describing the closest subject matter provide for a number of more or less complicated features that fail to solve the problem in an efficient and economical way. Applicant is not aware of any illuminated vehicle lift assemblies used to facilitate the changing of a vehicle wheel assembly having the novel features of the present invention.

SUMMARY OF THE INVENTION

The present invention is an illuminated vehicle lift assembly comprising a jack assembly having a top wall, a base wall, first and second lateral walls, a front wall, a rear wall, and wheels. The jack assembly further comprises power means and illumination means. The present invention further comprises a handle assembly and an electrical system.

The illumination means is disposed at the top wall. The wheels have a brake assembly mounted thereto. The power means is a battery mounted within the jack assembly. The illumination means are light emitting diodes and/or bulbs. Extending from the rear wall is a receiving slot comprising retaining walls. The receiving slot and the retaining walls do not reach the base wall.

The jack assembly also comprises at least one handle, and a piston assembly. The piston assembly comprises a top telescopic member, an intermediate telescopic member, and a base telescopic member, a magnetic head is mounted to the top telescopic member. In a retracted position, the top telescopic member, the intermediate telescopic member, and the base telescopic member are housed within the jack assembly with the magnetic head protruding from the top wall.

The handle assembly comprises an attaching arm, an arm section, and an operational arm. The arm section perpendicularly extends from the attaching arm. The attaching arm comprises an end with locking protrusions extending therefrom. The operational arm is connected to the arm section with a hinge. The hinge permits the operational arm to move from a retracted position to an extracted position, and vise versa. The extracted position, the handle assembly has a substantial L-shape. An actuating pin is pressed to unlock the operational arm from the extracted position. The operational arm has a housing fixed at a distal end, and a handlebar extends from the housing.

The electrical system comprises a first electrical connector located at the end of the attaching arm, and a second electrical connector cooperatively disposed at the receiving slot to connect to each other when the handle assembly is mounted onto the jack assembly.

The handle assembly is connected to the jack assembly, whereby the end of the attaching arm is inserted into the receiving slot and the retaining walls cooperatively receive the locking protrusions. More specifically, the handle assembly mounts onto the jack assembly, whereby the end is forced into the receiving slot until the first electrical connector couples with the second electrical connector, and the retaining walls block, or otherwise restrict, the locking protrusions.

It is therefore one of the main objects of the present invention to provide an illuminated vehicle lift assembly that facilitates lifting of a vehicle for changing a vehicle wheel assembly.

It is another object of this invention to provide an illuminated vehicle lift assembly comprising a jack assembly with illumination means.

It is another object of this invention to provide an illuminated vehicle lift assembly comprising a detachable handle assembly.

It is another object of this invention to provide an illuminated vehicle lift assembly that is volumetrically efficient for carrying, transporting, and storage.

It is another object of this invention to provide an illuminated vehicle lift assembly that can be utilized without the need of any special tools.

It is another object of this invention to provide an illuminated vehicle lift assembly, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
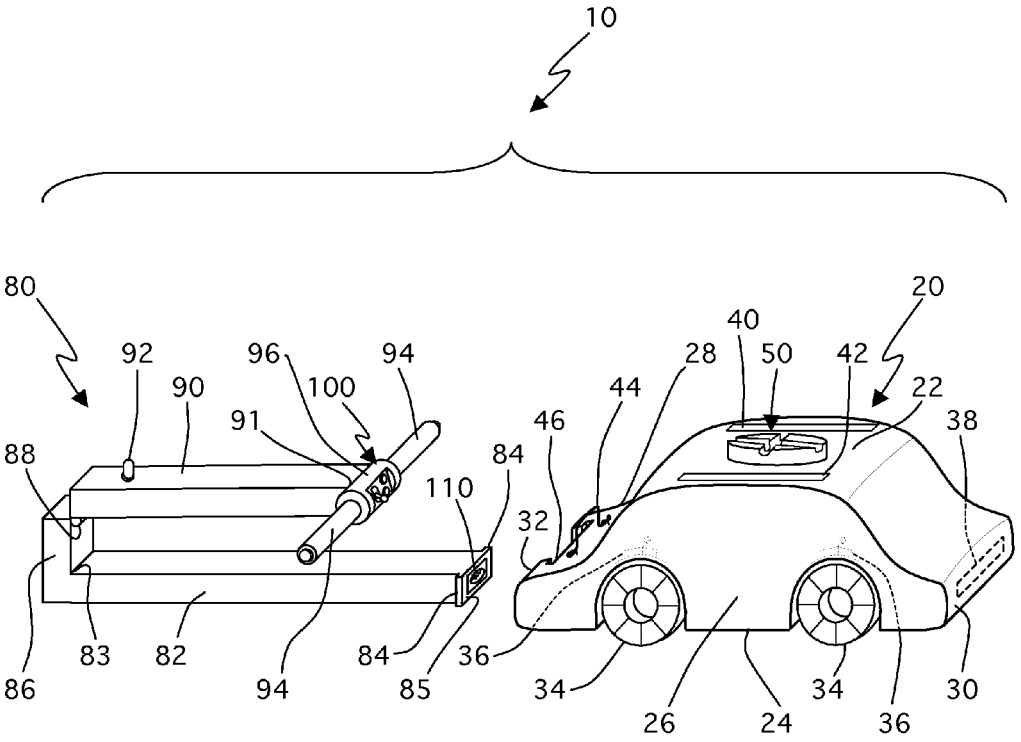
FIG. 1 is a first isometric view of an illuminated vehicle lift assembly, object of the present invention, with its detachable handle assembly in a retracted position and its piston assembly fully retracted.

Referring now to the drawings, the present invention is generally referred to with numeral 10. It can be observed that it basically includes jack assembly 20, handle assembly 80, and electrical system 100.

Figure 2:
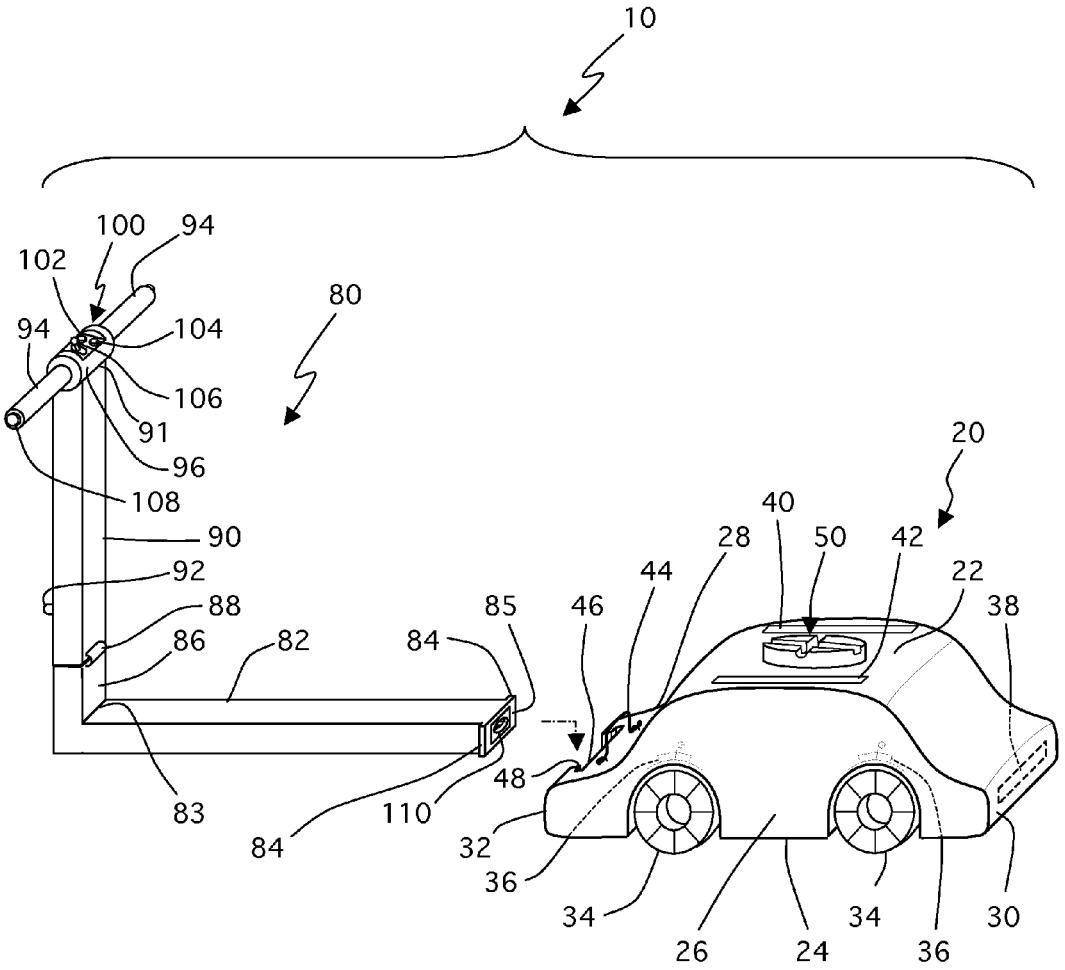
FIG. 2 is a second isometric view of the illuminated vehicle lift assembly, with its detachable handle assembly in an extracted position and its piston assembly fully retracted.

As seen in FIGS. 1 and 2, in a preferred embodiment, jack assembly 20 comprises top wall 22, base wall 24, lateral walls 26 and 28, front wall 30, rear wall 32 and wheels 34. Wheels 34 have brake assembly 36 internally mounted thereto. As a power means, battery 38 is internally mounted within jack assembly 20. In a preferred embodiment, battery 38 has sufficient energy to power present invention 10. Illumination means 40 and 42 are disposed at top wall 22. Illumination means 40 and 42 can be light emitting diodes (LEDs), bulbs, or other type of illuminating means. Extending inwardly from rear wall 32 is receiving slot 46. It is noted that receiving slot 46 comprises retaining walls 48, and does not reach base wall 24. Jack assembly 20 also comprises at least one handle 44. In the preferred embodiment handle 44 is mounted at a predetermined distance from rear wall 32. However, handle 44 may be mounted next to front wall 30 or at any other suitable part of jack assembly 20. Handle 44 is utilized to move and/or maneuver present invention 10. Jack assembly 20 further comprises piston assembly 50.

Handle assembly 80 comprises attaching arm 82, arm section 86 and operational arm 90. Arm section 86 perpendicularly extends from end 83. Attaching arm 82 further comprises end 85 with locking protrusions 84 extending laterally therefrom.

Operational arm 90 is connected to arm section 86 with hinge 88. Hinge 88 permits operational arm 90 to move from the retracted position, seen in FIG. 1, to the extracted position, seen in FIG. 2, and vise versa. In the extracted position, handle assembly 80 has a substantial L-shape. Actuating pin 92 needs to be pressed to unlock operational arm 90 from the extracted position. Operational arm 90 has housing 96 fixed at distal end 91. Handlebar 94 extends laterally from housing 96.

As seen in FIG. 2, electrical system 100 comprises light switch 102, brake switch 104, and piston assembly switch 106 disposed at housing 96, and power switch 108 disposed at a distal end, or ends, of handlebar 94.

Figure 3:
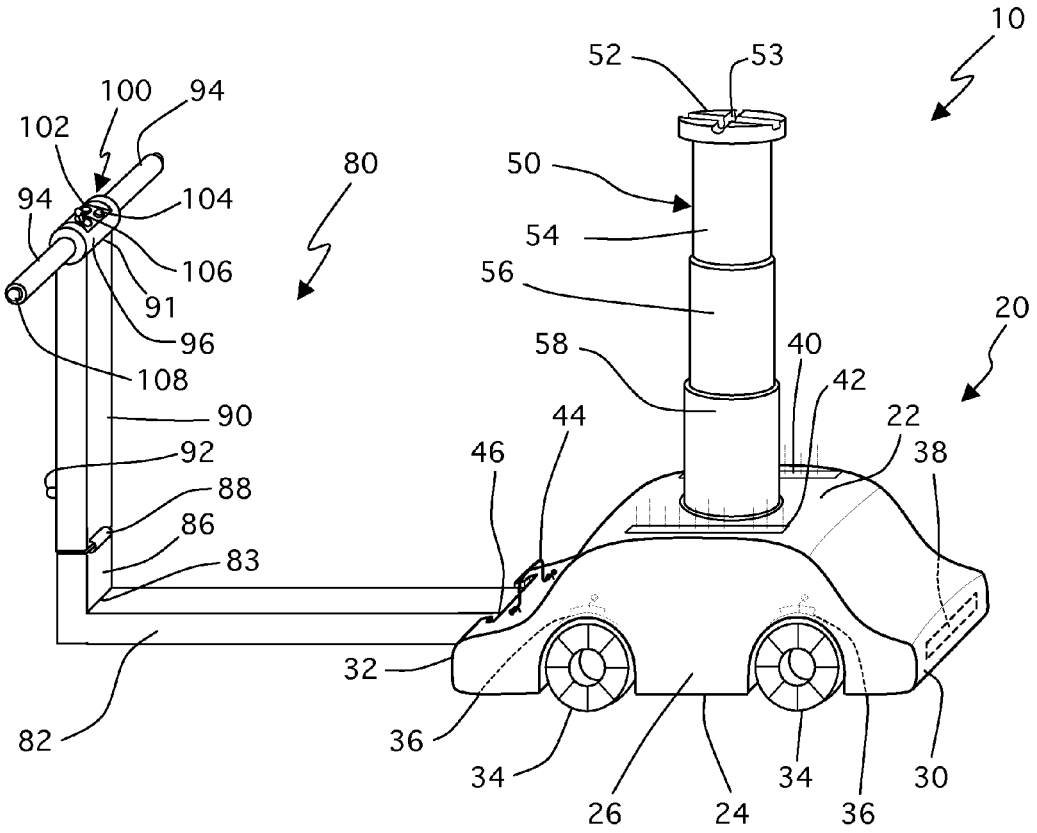
FIG. 3 is a third isometric view of the illuminated vehicle lift assembly, with its handle assembly mounted thereon, and its piston assembly fully extended.
Figure 3A:
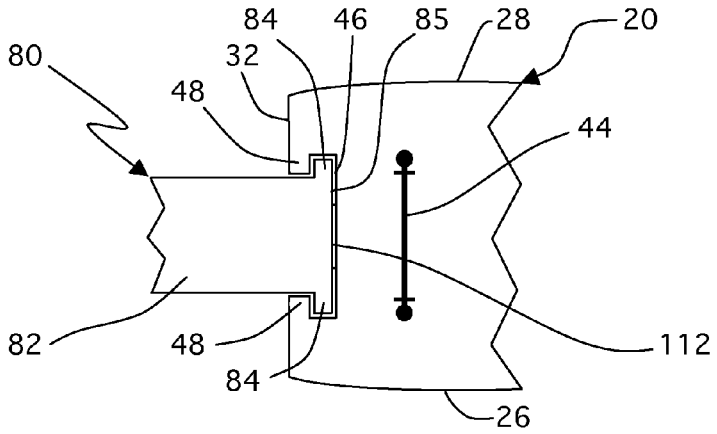
FIG. 3A is a top view partially showing the handle assembly mounted onto the jack assembly.

As seen in FIGS. 2, 3, and 3A, electrical system 100 further comprises electrical connector 110 and electrical connector 112. Electrical connector 110 is located at end 85 of attaching arm 82, and electrical connector 112 is cooperatively disposed at receiving slot 46 to connect to each other when handle assembly 80 is mounted onto jack assembly 20, as seen in FIG. 3. Brake assembly 36, battery 38, illumination means 40 and 42, and piston assembly 50 are actuated by electrical system 100. Power switch 108 turns electrical system 100 "ON" and "OFF". Light switch 102 turns illumination means 40 and 42 "ON" and "OFF". Brake switch 104 actuates brake assembly 36. Piston assembly switch 106 actuates piston assembly 50.

As seen in FIG. 3, in a preferred embodiment, piston assembly 50 comprises top telescopic member 54, intermediate telescopic member 56 and base telescopic member 58. Magnetic head 52 is mounted to top telescopic member 54. Magnetic head 52 has cross member 53. In the retracted position shown in FIGS. 1 and 2, top telescopic member 54, intermediate telescopic member 56, and base telescopic member 58 are housed within jack assembly 20, with magnetic head 52 protruding from top wall 22.

As seen in FIG. 3A, handle assembly 80 is connected to jack assembly 20, whereby end 85 of attaching arm 82 is inserted into receiving slot 46. Receiving slot 46 comprises retaining walls 48, which cooperatively receive locking protrusions 84 and keep them from disengaging when handle assembly 80 is moved back and forth. Specifically, to mount handle assembly 80 onto jack assembly 20, end 85 is forced into receiving slot 46 until electrical connector 110 couples with electrical connector 112, and retaining walls 48 block, or otherwise restrict, locking protrusions 84.

Figure 4:
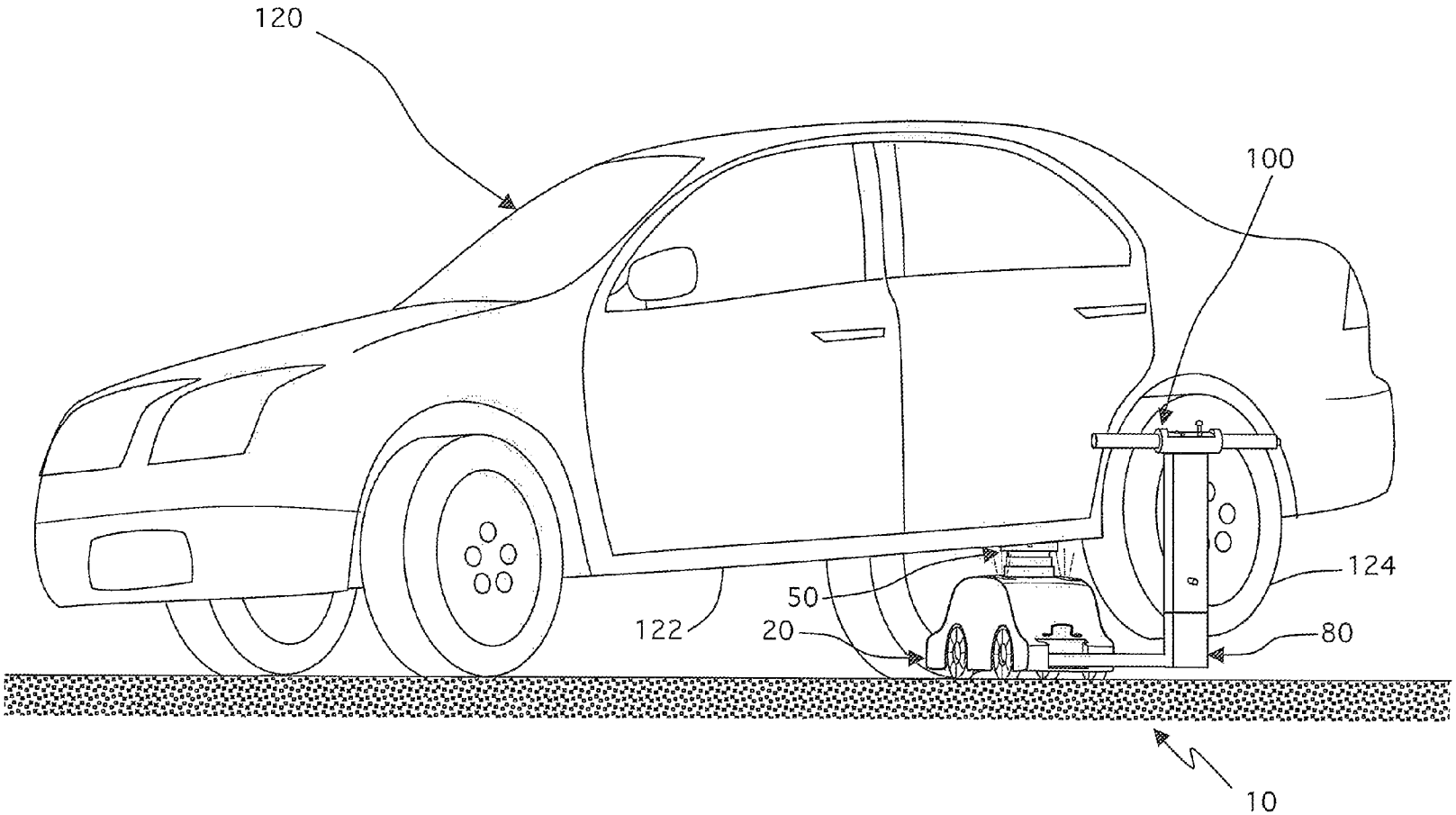
FIG. 4 is an isometric view of the present invention presented at the underside of a vehicle.

As seen in FIG. 4, in operation present invention 10 is presented at underside 122 of vehicle 120 comprising at least one wheel assembly 124. Electrical system 100 is turned "ON" with power switch 108. Light switch 102 controls illumination means 40 and 42 to facilitate visibility of underside 122. Using handlebars 94, jack assembly 20 is positioned so that piston assembly 50 is placed at a desired location at underside 122 of vehicle 120. Once piston assembly 50 is aligned with the desired location of underside 122, brake assembly 36 is activated with brake switch 104. Piston assembly switch 106 is actuated to extend top, intermediate, and base telescopic members 54, 56, and 58 respectively to a desired height. If desired, handle assembly 80 may be detached from jack assembly 20 to facilitate changing of the flat tire, and then reattached once the flat tire of wheel assembly 124 has been changed and secured. Although not illustrated, it is understood that present invention 10 comprises piston displacement means such as a pump, an electric piston pump, and/or a hydraulic piston pump to extend and retract top, intermediate, and base telescopic members 54, 56, and 58 respectively. Once the flat tire of wheel assembly 124 has been changed and secured, piston assembly switch 106 is actuated to retract top, intermediate, and base telescopic members 54, 56, and 58 respectively. Then, brake assembly 36 is unlocked. Once present invention 10 is safely cleared from vehicle 120, operational arm 90 folds toward attaching arm 82 by pressing actuating pin 92, and handle assembly 80 may be detached from jack assembly 20 to store present invention 10 in a trunk of vehicle 120 or any other suitable place.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An illuminated vehicle lift assembly, comprising:

A) a jack assembly having a top wall, a base wall, first and second lateral walls, a front wall, a rear wall, and wheels, said jack assembly further comprises power means and illumination means, extending from said rear wall is a receiving slot comprising retaining walls, said receiving slot and said retaining walls do not reach said base wall;

B) a handle assembly comprising an attaching arm, an arm section, and an operational arm, said arm section perpendicularly extends from said attaching arm, said attaching arm comprises an end with locking protrusions extending therefrom, said operational arm is connected to said arm section with a hinge, said hinge permits said operational arm to move from a retracted position to an extracted position, and vise versa; and C) an electrical system.

2. The illuminated vehicle lift assembly set forth in claim 1, further characterized in that said illumination means is disposed at said top wall.

3. The illuminated vehicle lift assembly set forth in claim 1, further characterized in that said wheels have a brake assembly mounted thereto.

4. The illuminated vehicle lift assembly set forth in claim 1, further characterized in that said power means is a battery mounted within said jack assembly.

5. The illuminated vehicle lift assembly set forth in claim 1, further characterized in that said illumination means are light emitting diodes and/or bulbs.

6. The illuminated vehicle lift assembly set forth in claim 1, further characterized in that said jack assembly also comprises at least one handle.

7. The illuminated vehicle lift assembly set forth in claim 1, further characterized in that said jack assembly also comprises a piston assembly.

8. The illuminated vehicle lift assembly set forth in claim 7, further characterized in that said piston assembly comprises a top telescopic member, an intermediate telescopic member, and a base telescopic member, a magnetic head is mounted to said top telescopic member.

9. The illuminated vehicle lift assembly set forth in claim 8, further characterized in that in a retracted position, said top telescopic member, said intermediate telescopic member, and said base telescopic member are housed within said jack assembly with said magnetic head protruding from said top wall.

10. The illuminated vehicle lift assembly set forth in claim 1, further characterized in that in said extracted position, said handle assembly has a substantial L-shape.

11. The illuminated vehicle lift assembly set forth in claim 1, further characterized in that an actuating pin is pressed to unlock said operational arm from said extracted position.

12. The illuminated vehicle lift assembly set forth in claim 11, further characterized in that said operational arm has a housing fixed at a distal end, and a handlebar extends from said housing.

13. The illuminated vehicle lift assembly set forth in claim 1, further characterized in that said electrical system comprises a first electrical connector located at said end of said attaching arm, and a second electrical connector cooperatively disposed at said receiving slot to connect to each other when said handle assembly is mounted onto said jack assembly.

14. The illuminated vehicle lift assembly set forth in claim 13, further characterized in that said handle assembly mounts onto said jack assembly, whereby said end is forced into said receiving slot until said first electrical connector couples with said second electrical connector, and said retaining walls block, or otherwise restrict, said locking protrusions.

15. The illuminated vehicle lift assembly set forth in claim 1, further characterized in that said handle assembly is connected to said jack assembly, whereby said end of said attaching arm is inserted into said receiving slot and said retaining walls cooperatively receive said locking protrusions.

* * * * *